US011717735B1

(12) United States Patent
Wegener et al.

(10) Patent No.: US 11,717,735 B1
(45) Date of Patent: Aug. 8, 2023

(54) MAGNETIC PRACTICE TARGETS

(71) Applicant: Top Shelf Targets, LLC, San Jose, CA (US)

(72) Inventors: Adam Stephen Wegener, Santa Clara, CA (US); David J. Maley, Excelsior, MN (US); Robert Herbst, San Jose, CA (US)

(73) Assignee: TOP SHELF TARGETS, LLC, San Jose, CA (US)

( * ) Notice: Subject to any disclaimer, the term of this patent is extended or adjusted under 35 U.S.C. 154(b) by 0 days.

(21) Appl. No.: 16/292,128

(22) Filed: Mar. 4, 2019

Related U.S. Application Data

(63) Continuation-in-part of application No. 15/050,234, filed on Feb. 22, 2016.

(51) Int. Cl.

| | |
|---|---|
| ***A63B 69/00*** | (2006.01) |
| ***A63B 63/00*** | (2006.01) |
| ***A63B 102/24*** | (2015.01) |
| ***A63B 102/14*** | (2015.01) |

(52) U.S. Cl.
CPC ..... *A63B 69/00* (2013.01); *A63B 63/004* (2013.01); *A63B 69/002* (2013.01); *A63B 69/0024* (2013.01); *A63B 2102/14* (2015.10); *A63B 2102/24* (2015.10); *A63B 2209/08* (2013.01); *A63B 2243/0025* (2013.01)

(58) Field of Classification Search
CPC ..... A01K 97/06; B25H 3/06; B25H 3/00
See application file for complete search history.

(56) References Cited

U.S. PATENT DOCUMENTS

| | | | | |
|---|---|---|---|---|
| 4,842,283 | A | 6/1989 | LeBel et al. | |
| 4,953,864 | A * | 9/1990 | Katz | A63F 9/34 273/138.2 |
| 5,470,057 | A | 11/1995 | Bodford, Jr. | |
| 5,509,650 | A | 4/1996 | MacDonald | |
| 5,669,516 | A * | 9/1997 | Horn | B25H 3/06 |
| 5,743,394 | A * | 4/1998 | Martin | B25H 3/003 |
| 5,888,153 | A | 3/1999 | Masin | |
| 7,252,604 | B2 | 8/2007 | Birss | |
| 2003/0141661 | A1 | 7/2003 | MacEachern | |
| 2008/0169210 | A1* | 7/2008 | Heidenreich | A63B 55/408 211/70.2 |
| 2008/0214331 | A1* | 9/2008 | Talafous et al. | A63B 69/0026 273/393 |
| 2010/0269400 | A1* | 10/2010 | Gesik | A01K 97/06 43/57.1 |

* cited by examiner

*Primary Examiner* — Eugene L Kim
*Assistant Examiner* — Christopher Glenn
(74) *Attorney, Agent, or Firm* — Jason P. Webb; Pearson Butler

(57) ABSTRACT

A practice target that includes: a front face; a rear face; a side face with a plurality of pockets, including first and second sets of pockets into which are disposed first and second sets of magnets. The first and second sets of magnets are identical in shape but are oriented opposite each other so that when the practice targets are stacked they have mutual attraction instead of being repelled by like magnets. The magnets include notches/cutouts/protrusions/etc. that match with similar structures in the pockets to hold them in place in the pockets. There are off-center pin holes through the magnets that make sure that they are oriented correctly during injection molding. There are netting grooves between the plurality of pockets and a tether aperture with a tether for attaching to a net.

19 Claims, 17 Drawing Sheets

MAGNETIC PRACTICE TARGETS

BACKGROUND OF THE INVENTION

CROSS REFERENCE TO RELATED APPLICATIONS

This invention is a continuation-in-part, under 37 C.F.R. 1.53(b) and claims priority, under 35 U.S.C. § 120, to the U.S. Pat. Application No. 15/050,234 by Robert Herbst filed on 22 Feb. 2016, which is incorporated by reference herein in its entirety.

FIELD OF THE INVENTION

The present invention relates to an apparatus for practicing hitting a portable target assembly attached to a goal post or crossbar to improve a person's accuracy.

DESCRIPTION OF THE RELATED ART

In sports having a goal protected by a goalie there are areas around the perimeter of the goal that are more likely to result in a propelled object getting by the goalie. The perimeter of the goal opening in hockey is generally defined by two vertical goal posts separated by an upper crossbar and the playing surface. Practice targets are attached to the goal posts or crossbar for a player to aim at during a practice session. Some improvements have been made in the field. Examples of references related to the present invention are described below, and the supporting teachings of each reference are incorporated by reference herein:

U.S. Pat. No. 4,842,283 by LeBel and Melendez discloses a contact member springily associated with a support arm which is used to mount a portable target assembly to a support which preferably includes the crossbar or posts of a standard hockey goal. The support arm is attached to the post or crossbar using a bolt making it difficult to quickly remove the portable target assembly. Also, the size reduces the portability of the target by a player.

U.S. Pat. No. 5,509,650 by MacDonald discloses a target support sized to approximate the goal and at least two targets positioned thereon. The practice apparatus is preferably a freestanding apparatus supported by support legs. Due to the size of this practice assembly it is not easily portable by a player.

U.S. Pat. No. 5,888,153 by Masin discloses a target which includes a band of steel with a pocket connected to the band of steel for catching an object. A spring is, at one end, connected to the target and, at the opposite end connected to a clamping device such that the entire assembly can be connected to a goal post or crossbar. The clamping device increased the size and amount of time to remove the target from the post or crossbar thus reducing the portability of the target.

U.S. Pat. No. 7,252,604 by Birss discloses a target apparatus that includes a bracket for attachment to a goal frame member. The target apparatus being physically clamped to the post or crossbar increases the difficulty of removing the target and reduces its portability by a player.

The inventions heretofore known suffer from a number of disadvantages which include not being durable, not being portable, not being weather/temperature resistant, lending to poor quality manufacturing, being difficult to manufacture, failing to have consistent products over large manufacturing batches, being weak, and/or being difficult to use.

What is needed is a practice target and/or manufacturing method for manufacturing a practice target that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available practice targets. Accordingly, the present invention has been developed to provide an improved practice target.

According to one non-limiting embodiment of the invention, there is a practice target that includes one or more of: a front face; a rear face, wherein the rear face may be opposite the front face; a side face that may be at a side end of the practice target and/or may be adjacent to one or each of the front face and rear face; a plurality of pockets that may be disposed along the side face, wherein the plurality of pockets may include a first set of pockets and/or a second set of pockets; a plurality of netting grooves that may be disposed between the plurality of pockets; a tether aperture that may extend through the front face and or the rear face; and/or a plurality of magnets.

The plurality of magnets may include a first set of magnets that may be disposed within the first set of pockets and/or may be oriented according to a first magnetic orientation; and/or a second set of magnets that may be disposed within the second set of pockets. It may be that the second set of magnets are oriented within the second set of pockets to have a magnetic orientation that is opposite to the first magnetic orientation.

It may be that one, more, or each of the plurality of magnets includes a magnet body that may have a magnet convexity and/or concavity that may be disposed asymmetrically thereon that may mate with a corresponding pocket concavity and/or convexity of an associated pocket within which the magnet body is disposed which may operate together to secure the magnet body within the associated pocket.

It may be that one, more, or each magnet of the plurality of magnets includes a pair of concavities disposed opposite each other along sides of the magnet which mate with a pair of convexities within a pocket inside which the magnet is disposed to secure the magnet, wherein the pair of concavities are disposed off-center along their respective sides.

It may be that one, more, or each of the plurality of magnets are rectangular and/or have an identical asymmetric irregularity in shape mating with a corresponding irregularity in shape in one, more, or each corresponding pocket.

It may be that one, more, or each of the plurality of magnets may include a pin hole that may be disposed off-center along at least one axis and/or wherein each of the plurality of magnets has a same magnetic orientation in relation to the position of the pin hole.

It may be that the tether aperture is disposed near an edge of the practice target midway between the side face and a face opposite the side face.

It may be that a difference between a number of magnets of the first set of magnets and a number of magnets of the second set of magnets is no greater than one.

It may be that the front face and rear face are substantially flat such that a plurality of practice targets may be stacked together.

It may be that one, more, or each of the pockets includes a lateral hole through either the front face or the rear face that matches with the pin hole of the corresponding magnet body. It may be that the lateral hole is larger in diameter than the associated pin hole.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
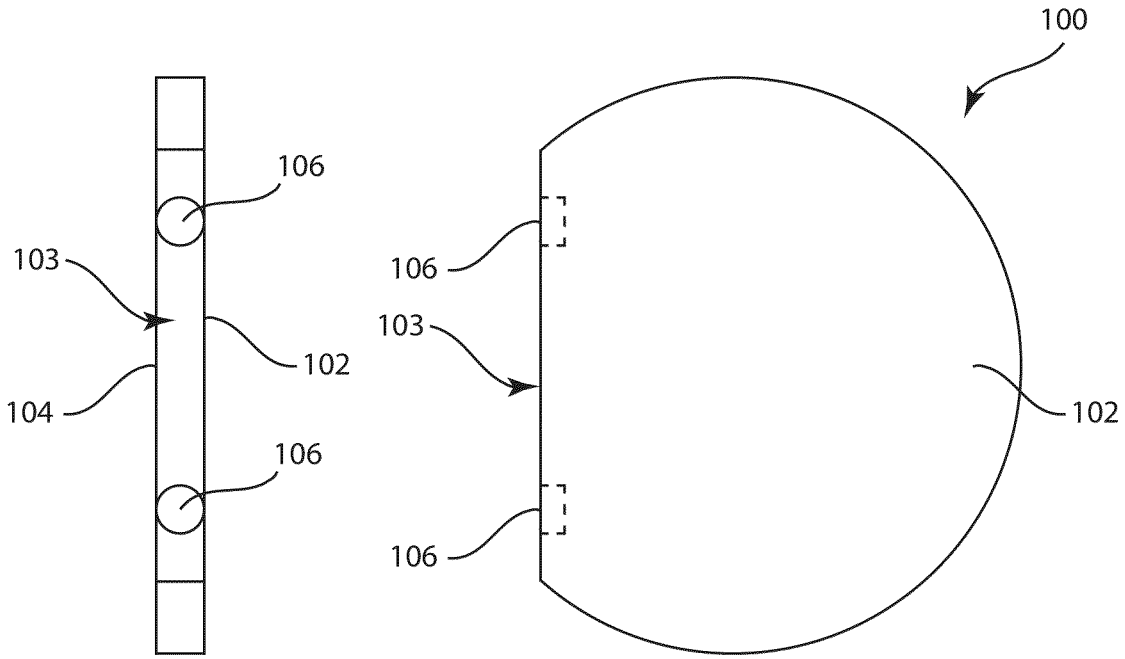
FIG. 1 illustrates one embodiment of a portable target assembly wherein permanent magnets are embedded in the portable target assembly.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

In general, the embodiments of this invention comprise securing a magnet to a portable target assembly such that the portable target assembly is easily attached to a magnetic goal post or crossbar. The magnets comprise permanent magnets and flexible magnetic materials. These portable target assemblies may be used in sports having a goal such as hockey, lacrosse, ringette, broomball, and soccer. When the goal post or crossbar is not made from a magnetic material a magnetically receptive material may be secured to the goal post or crossbar in at least one area allowing the portable target assembly to be attached. The target assemblies of the present invention are easily removed from the goal post or crossbar and stored in player's gym bag or other carrying device. The portable target assembly comprises a front face, a rear face, and a solid material between the front and rear face forming the body of the portable target assembly. An edge is formed around the circumference of the portable target assembly allowing at least one magnet to be secured on the surface of the edge, or partially or wholly within the body of the target wherein the portable target assembly attaches to a goal post or crossbar along the edge of the portable target assembly. An alternative is to secure at least one magnet to the surface of the rear face, or partially or wholly within the body of the assembly so that the portable target assembly attaches to the goal post or crossbar at the rear face of the portable target assembly.

FIG. 1 illustrates one embodiment of a portable target assembly 100 wherein permanent magnets 106 are embedded in the portable target assembly 100. In this embodiment the portable target assembly 100 is shown to be circular in shape with a portion of the circle missing along a chord of the circle to form a straight edge 103. The portable target assembly 100 shown has a front face 102 and a rear face 104 separated by a solid material. Two holes are depicted that have been created by removing material perpendicular to the straight edge 103, the holes being sized to securely receive two magnets 106. The magnets 106 are shown to be flush to the straight edge 103, but this is not a requirement as long as they are secured so they can't be pulled out of the portable target assembly 100.

Figure 2:
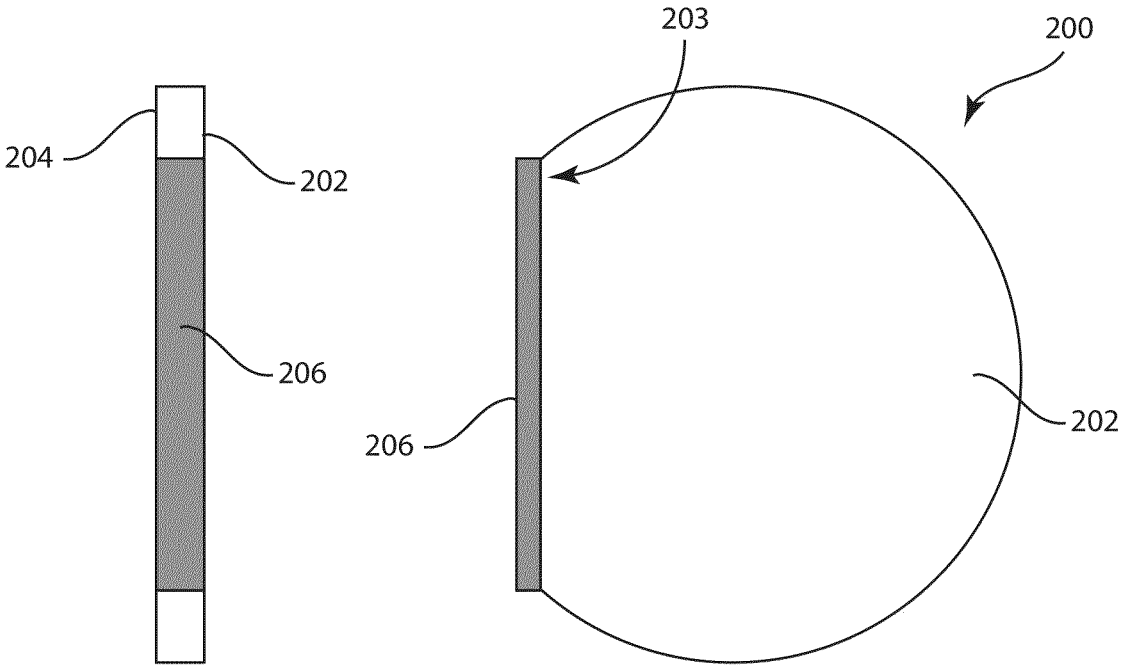
FIG. 2 illustrates yet another embodiment of a portable target assembly wherein a strip of magnetic material is secured to the portable target assembly.

FIG. 2 illustrates yet another embodiment of a portable target assembly 200 wherein a strip of magnetic material 206 is secured to the portable target assembly 200. In this embodiment the portable target assembly 200 is shown to be circular in shape with a straight edge 203. The portable target assembly 200 shown has a front face and a rear face separated by a solid material. A magnetic strip 206 is secured to the straight edge 203 of the portable target assembly.

Figure 3:
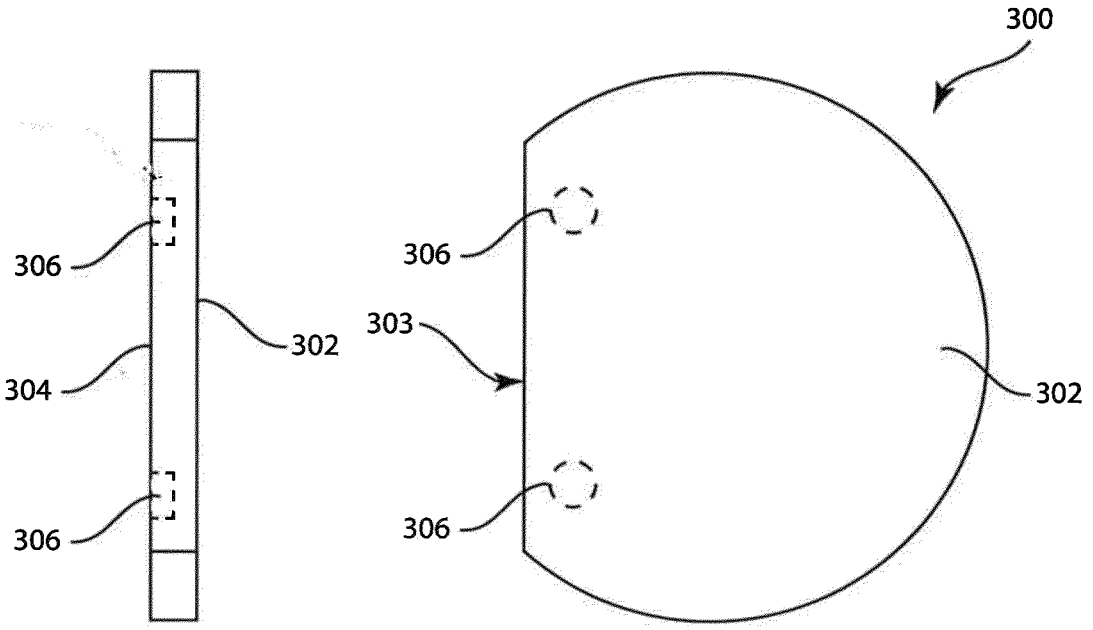
FIG. 3 illustrates yet another embodiment of a portable target assembly wherein permanent magnets are embedded in the rear face adjacent to the straight edge of the portable target assembly.

FIG. 3 illustrates yet another embodiment of a portable target assembly 300 wherein discreet magnets 306 are embedded in the rear face 304 adjacent to the straight edge of the portable target assembly 300. Two holes are depicted that have been created by removing material parallel to the rear face 304, the holes being sized to securely receive two magnets 306. The magnets 306 are shown to be flush to the rear face 304, but this is not a requirement as long as they are secured so they can't be pulled out of the portable target assembly.

Figure 4:
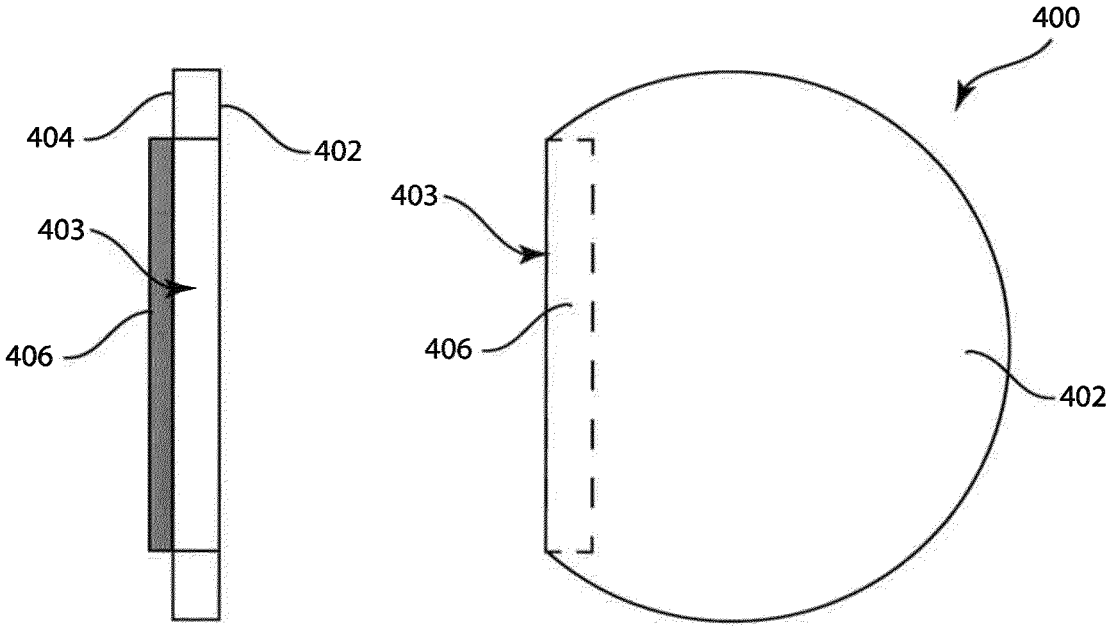
FIG. 4 illustrates yet another embodiment of a portable target assembly wherein a strip of magnetic material is secured to the portable target assembly.

FIG. 4 illustrates yet another embodiment of a portable target assembly 400 wherein a strip of magnetic material 406 is secured to the portable target assembly 400. In this embodiment the portable target assembly 400 is shown to be circular in shape with a straight edge 403. The portable target assembly 400 has a front face 402 and a rear face 404 separated by a solid material. A magnetic strip 406 is secured to the rear face 404 adjacent to the straight edge 403 of the portable target assembly 400.

Figure 5:
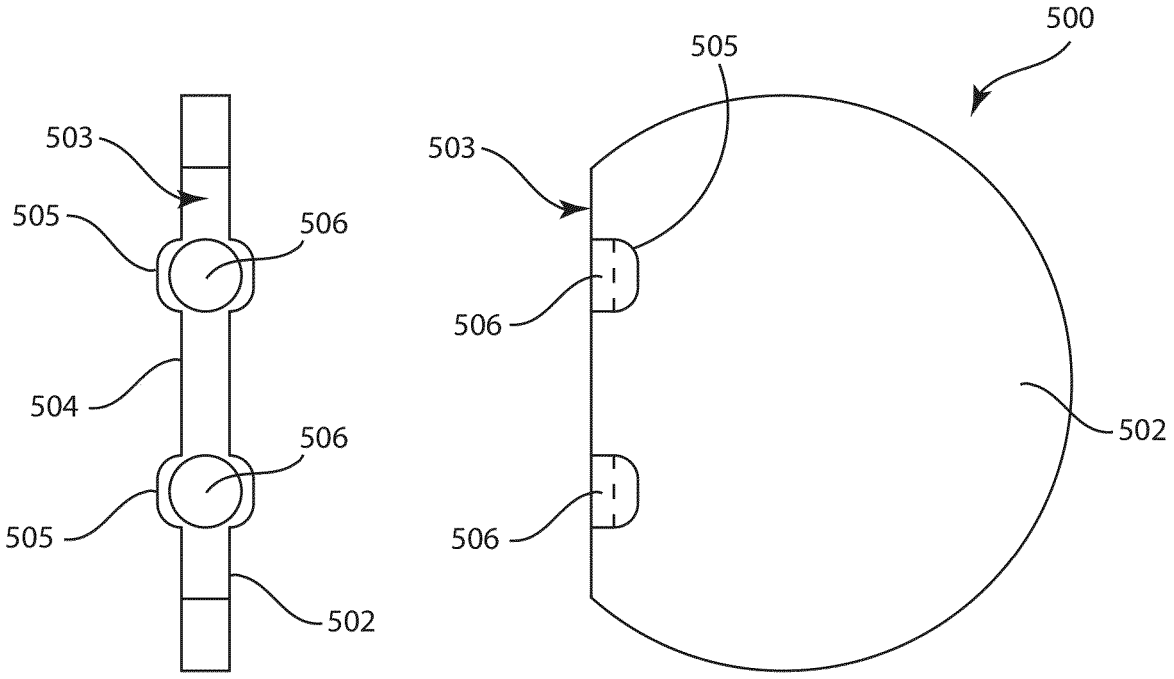
FIG. 5 illustrates yet another embodiment of a portable target assembly wherein two permanent magnets are embedded in the portable target assembly.

FIG. 5 illustrates yet another embodiment of a portable target assembly 500 wherein two permanent magnets 506 are embedded in the portable target assembly 500. In this embodiment the portable target assembly 500 is shown to be circular in shape with a straight edge 503. The portable target assembly 500 has a front face 502 and a rear face 504 separated by a solid material. There are two raised areas 505 on the front face 502 and the rear face 504 providing additional material in the area where the magnets are attached. Two holes are depicted that have been created by removing material perpendicular to the face of the straight edge 503 and centered in the raised areas 505, the holes being sized to securely receive two magnets 506. The magnets 506 are shown to be flush to the straight edge 503, but this is not a requirement as long as they are secured so they can't be pulled out of the portable target assembly.

Figure 6:
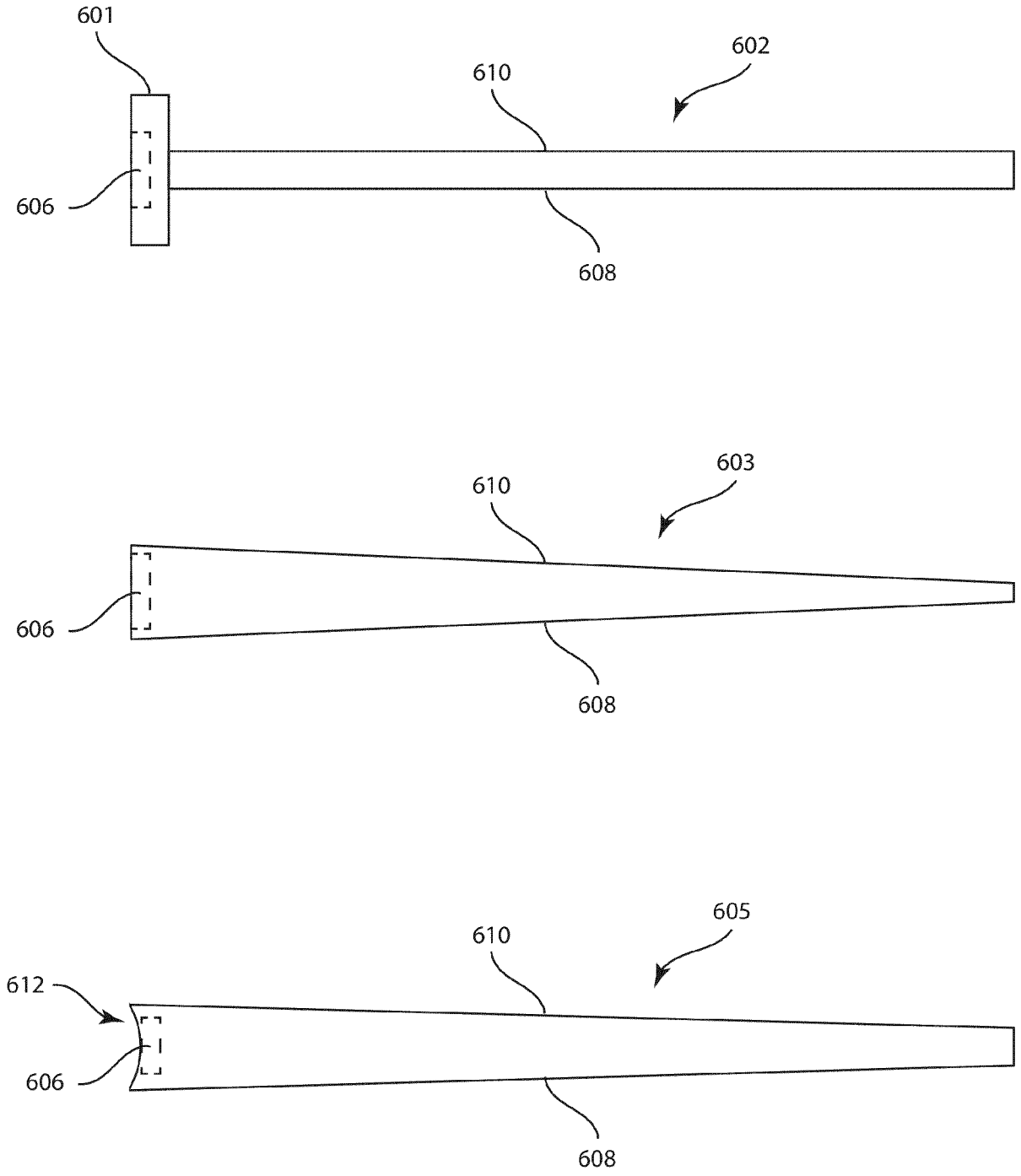
FIG. 6 illustrates different arrangements of the front face and rear face that may be used for the portable target assembly according to three embodiments of the invention.

FIG. 6 illustrates different arrangements of the front face and rear face that may be used for the portable target assembly according to three embodiments of the invention. Target assemble 602 is formed from two separate pieces of material being securely connected at a right angle to each other. At least one magnet 606 is embedded in a short piece 601 attached to the target area, the target area having a front face 608 and a rear face 610 that are parallel and separated by a solid material.

A second portable target assembly 603 has a front face 608 and a rear face 610 that are not parallel to each other. At least one magnet 606 is embedded in a straight edge of the portable target assembly.

In a third portable target assembly 605 the shape is the same as portable target assembly 603 except the straight edge has been formed into a concave shape 612 to match the curvature of a goal post and crossbar.

Figure 7:
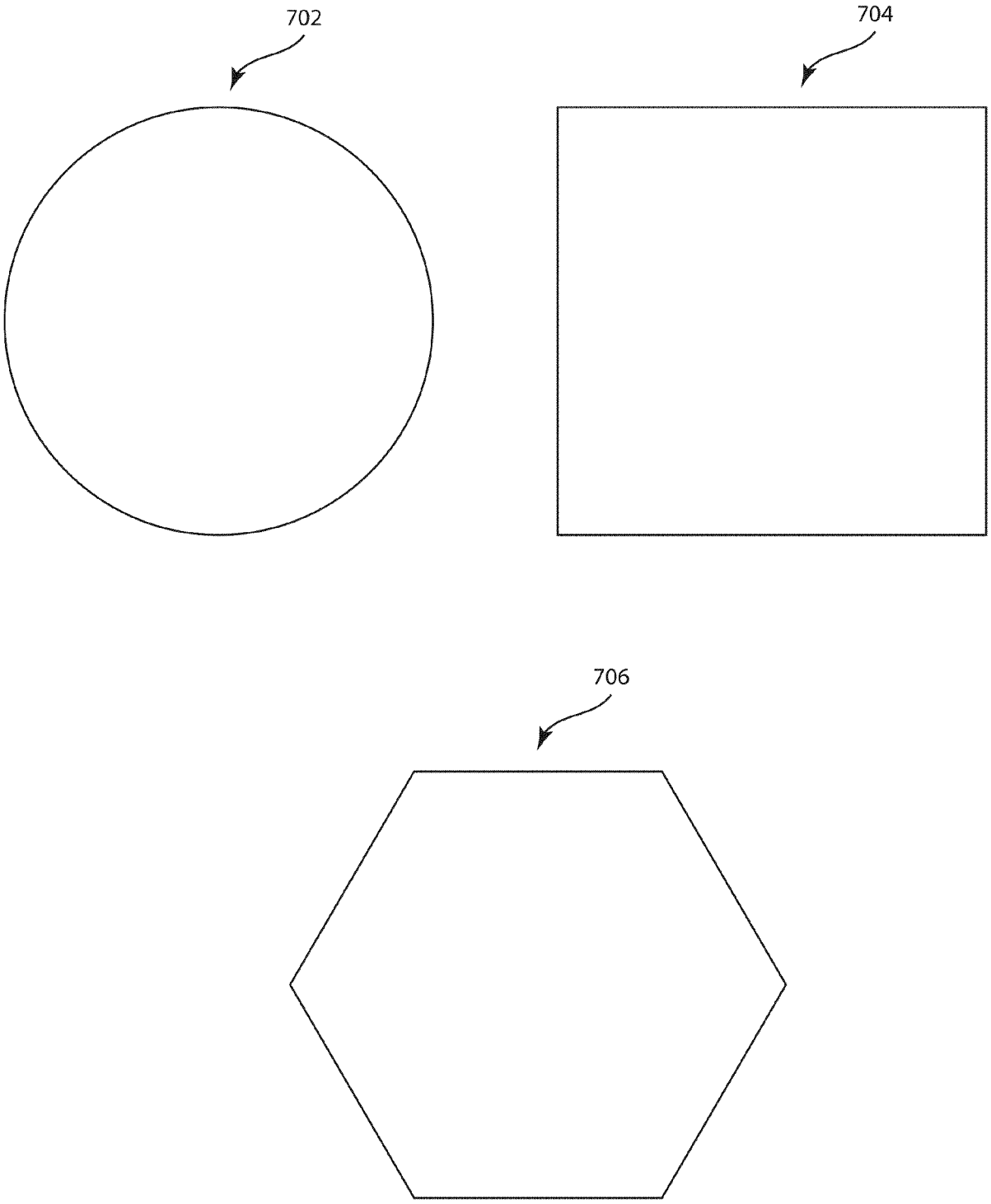
FIG. 7 illustrates additional configurations possible for the portable target assembly including a circle, rectangle, hexagon, or any other polygonal shape.

FIG. 7 illustrates different shapes that may be used for the portable target assembly. These shapes include but are not limited to a circle 702, a rectangle/square 704, and a hexagon 706. At least one magnet may be secured to the edge forming the circumference of the portable target assembly or on the rear face adjacent to a straight edge of the rectangle/square 704 or hexagon 706. In the case of a full circle 702 at least one magnet may be secured to the rear face along a chord of the circle.

Figure 8:
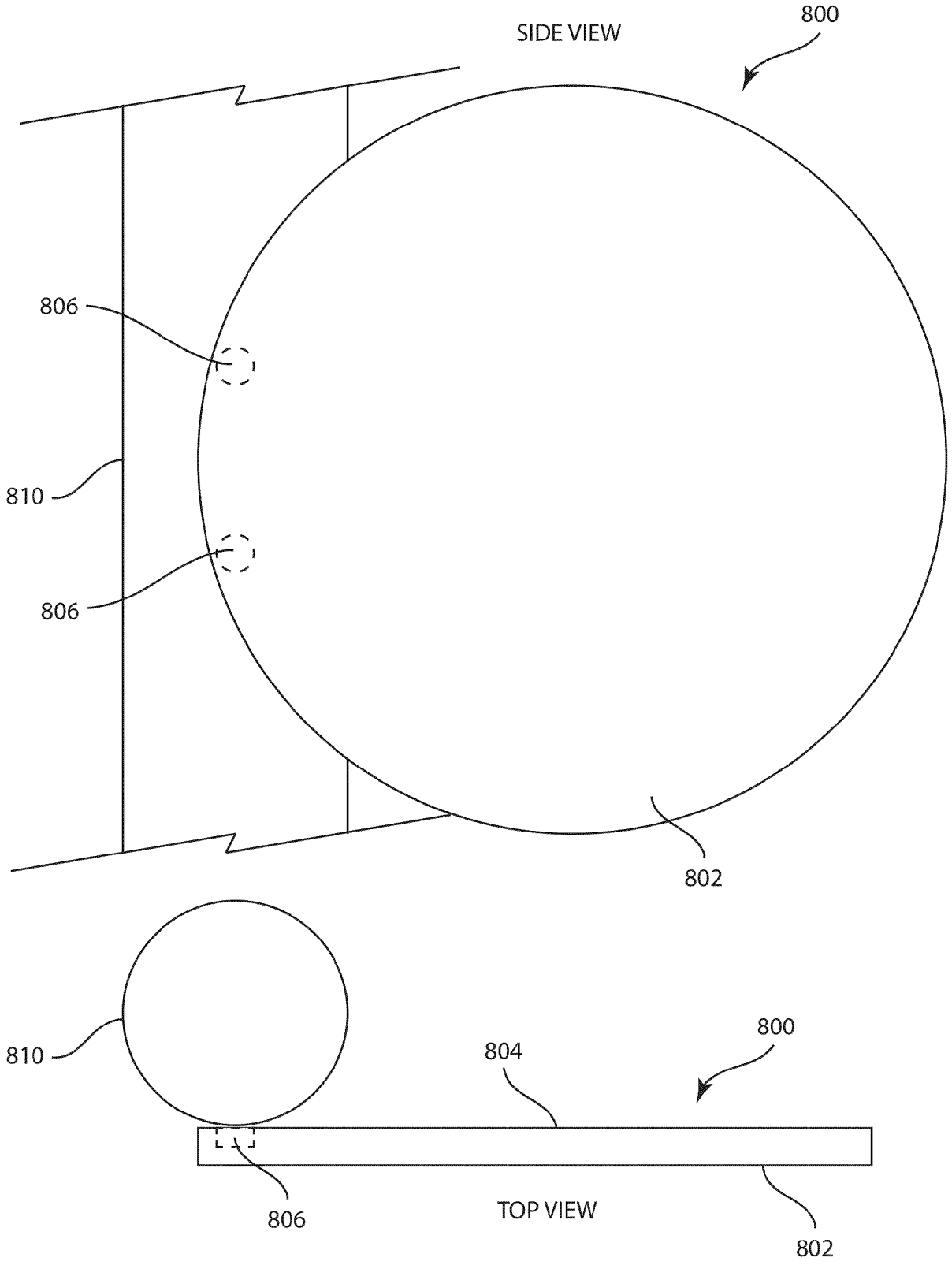
FIG. 8 illustrates a portable target assembly attached to a goal post according to one embodiment of the invention.

FIG. 8 illustrates a portable target assembly attached to a goal post according to one embodiment of the invention. A circular portable target assembly 800 has two magnets 806 embedded it the solid material separating the front face 802 from the rear face 804. The magnets 806 securely hold the portable target assembly 800 to the goal post 810. The goal post 810 in this embodiment is made from a magnetic material such as steel.

Figure 9:
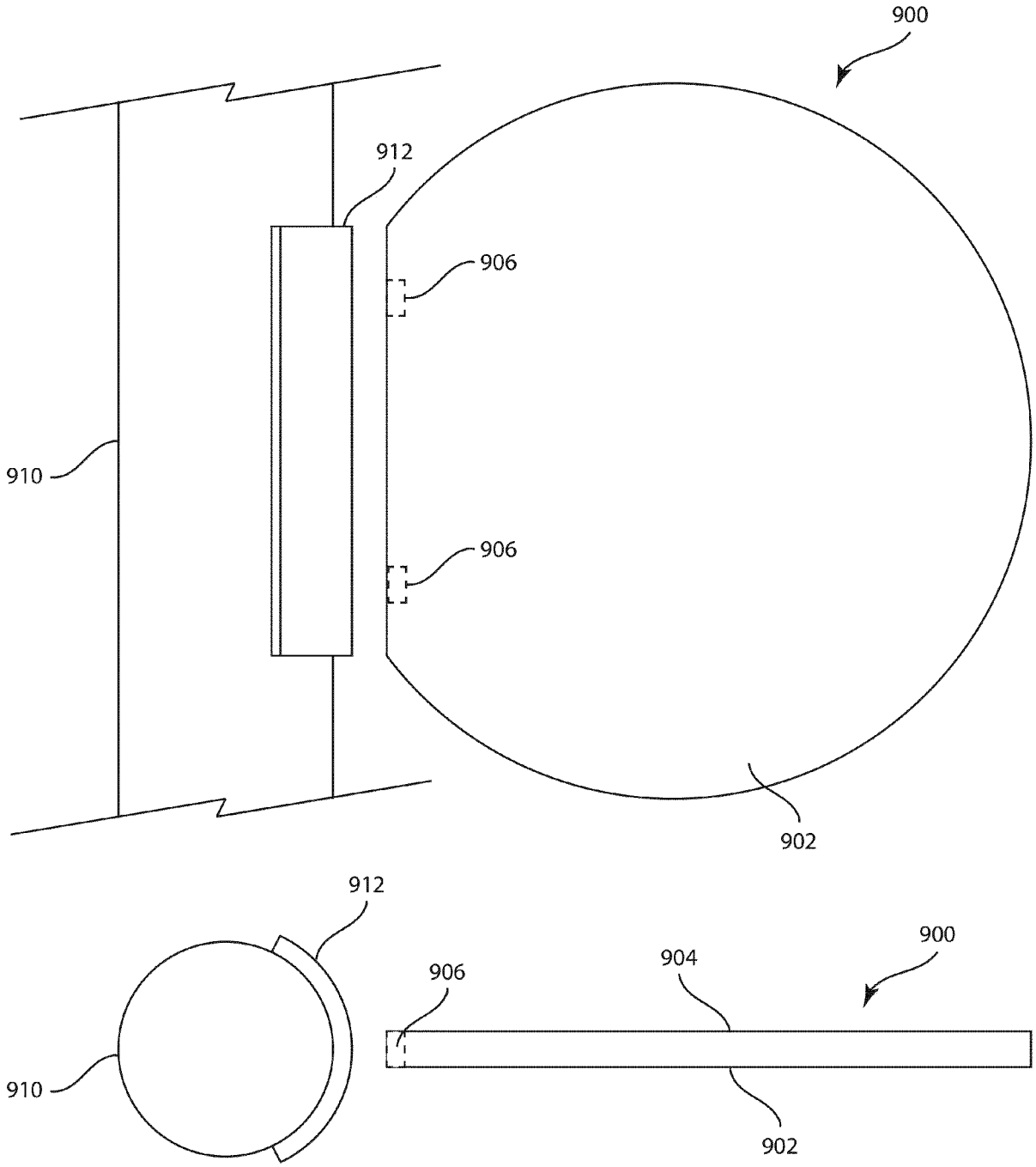
FIG. 9 illustrates a portable target assembly attached to a goal post made from a non-magnetic material according to one embodiment of the invention.

FIG. 9 illustrates a portable target assembly 900 attached to a goal post 910 made from a non-magnetic material according to one embodiment of the invention. In this case where the goal post and/or crossbar are not made from a magnetic material a magnetic receptive material must be attached to the goal post or crossbar in at least one position to allowing the attachment of a portable target assembly. In the illustration a strip of magnetic receptive material 912 is attached to the post 910. The magnets 906 of the portable target assembly 900 can then attach to the magnetic receptive strip 912. Magnetic receptive strips may be located at strategic points along the goal post and crossbar or a continuous magnetic receptive strip may be applied along the entire length of the goal posts and crossbar. The magnetic receptive strip may comprise flexible magnetic receptive materials as well as flexible magnetic materials.

Figure 10:
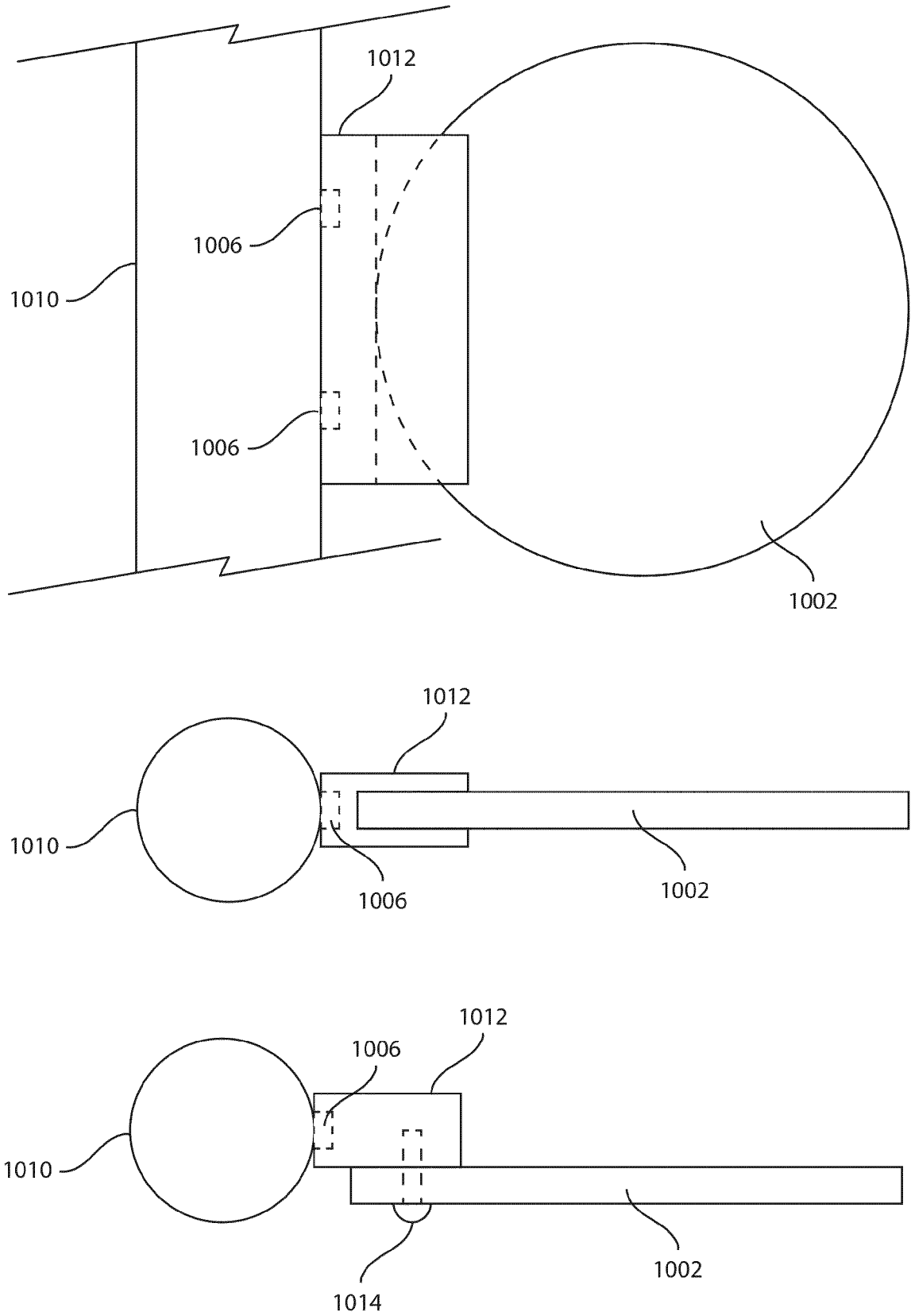
FIG. 10 illustrates yet another embodiment of a target assembly 1000 wherein a receptive body 1012 is magnetically attached to a goal post or crossbar 1010, a removable target body 1002 being secured to the receptive body 1012.

FIG. 10 illustrates yet another embodiment of a target assembly wherein a receptive body 1012 is magnetically attached to a goal post or crossbar 1010, a removable target body 1002 being secured to the receptive body 1012. Receptive body 1012 is magnetically attached to a goal post or crossbar 1010 by magnets 1006 secured to the receptive body 1012. In this embodiment a slot may be formed in the receptive body 1012 to accept a removable target body 1002. In one embodiment the removable target body 1002 is held in the slot by a compression fit. Other embodiments may include attaching the removable target body 1002 to the receptive body 1012 using screws 1014 or other means. In this manner different shapes and sizes of removable target bodies may be secured to the receptive body 1012. A player may start with a large removable target body and as they improve may change out the large removable target body for a smaller target body. The removable target bodies may be purchased or the player may use discarded materials such as compact discs, records, or other items.

Figure 11:
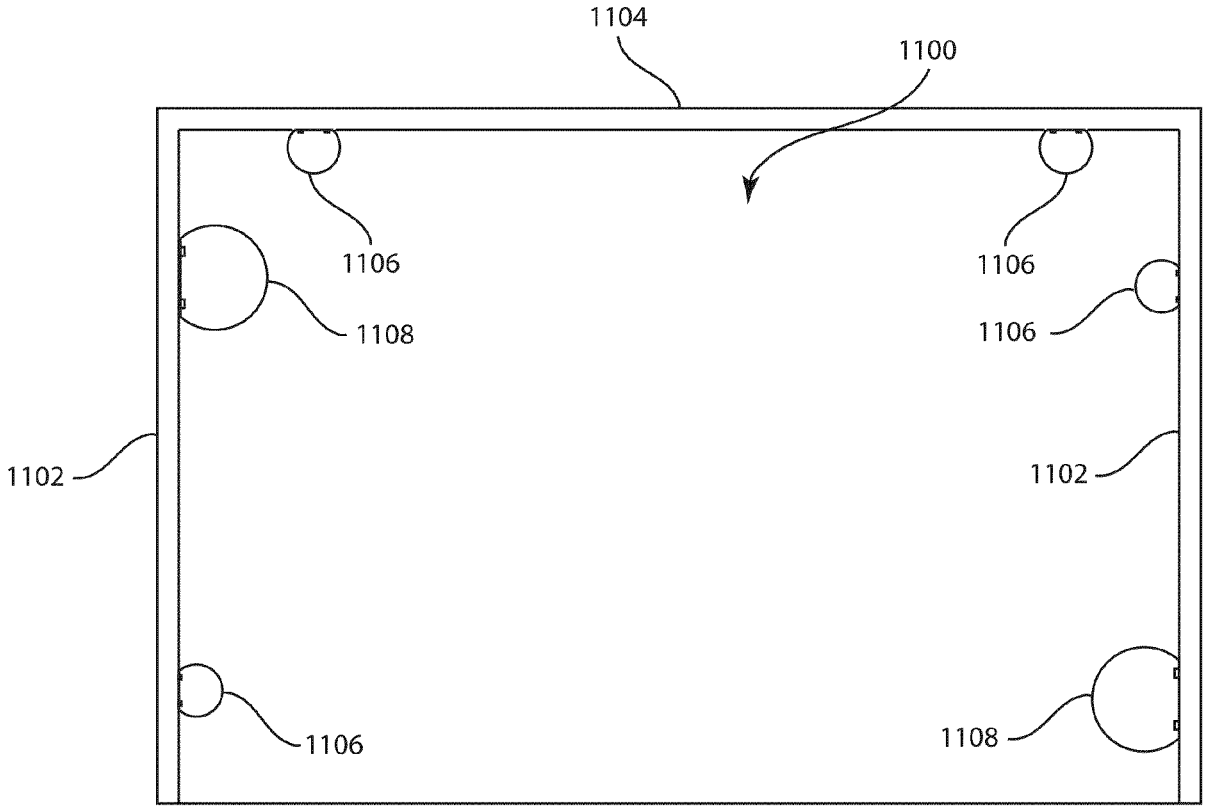
FIG. 11 illustrates the placement of target assemblies along a goal post or crossbar.
Figure 12:
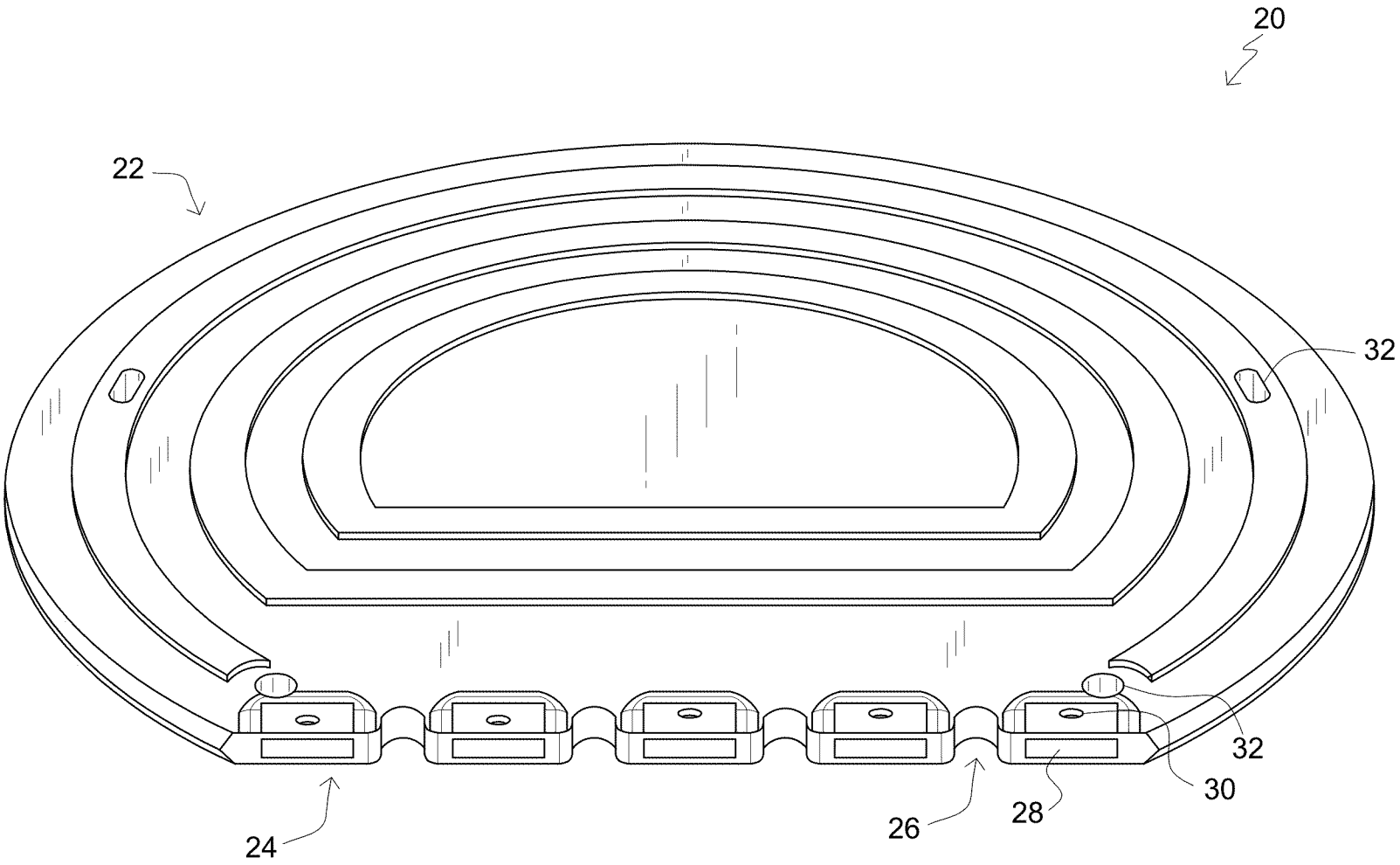
FIG. 12 is a side-front perspective view of a practice target, according to one embodiment of the invention.

FIG. 11 illustrates the placement of target assemblies along a goal post 1102 or crossbar 1104 wherein the target assembly protrudes into the goal region 1100 of the goal. The goal region 1100 defined as area between two goal posts, the playing surface, and the crossbar attached to the upper ends of the two goal posts and the playing surface. The portable target assembly positions are illustrative only and not necessarily the optimal positions for the placement of the target assemblies. Small targets 1106 and large targets 1108 may be placed along the goal posts 1102 and the crossbar 1104. Depending on the skill level of a player, an advanced player may use small target assemblies 1106, whereas a beginning player may want to use a large portable target assembly 1108. All skill levels can be easily accommodated since the target assemblies can be easily and quickly placed anywhere along the perimeter of the goal opening. Once a play is finished the portable target assemblies can be quickly removed and stored in a gym bag or other carrying case. It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

A method of sports training comprises providing a portable target assembly having a front face and a rear face separated by a solid material with a magnet secured thereto, securing the portable target to a goal post or a crossbar of a goal such that the portable target assembly protrudes into the goal region of the goal, and launching a projectile at the portable target assembly. The method further comprises coupling a magnetically receptive material to a goal that is not magnetically receptive such that the magnet of the portable target assembly may be magnetically coupled thereto. The portable target assembly may include a straight edge and the magnet is disposed on the portable target assembly near the straight edge thereof.

The illustrative embodiments disclosed herein have been shown having two magnets or a single piece of magnetic material. It is not a requirement that two magnets or a single strip of magnetic material be used since any number of magnets or strips of magnetic material may be used as long as the portable target assembly can be easily attached to a goal post or crossbar and quickly and easily removed by a player. The magnet shape need not be round, but may be any shape or thickness as long as the portable target assembly can attach to a goal post or crossbar. The magnets are shown to be flush to a straight edge or in contact with the surface of the portable target assembly, but this is not a requirement as long as they are secured so they can't be pulled out of the portable target assembly. Magnets may be embedded in the portable target assembly but extend partially above the surface, or completely embedded within the body of the portable target assembly. As long as the result allows the portable target assembly to be magnetically attaches to a goal post or crossbar.

Figure 16:
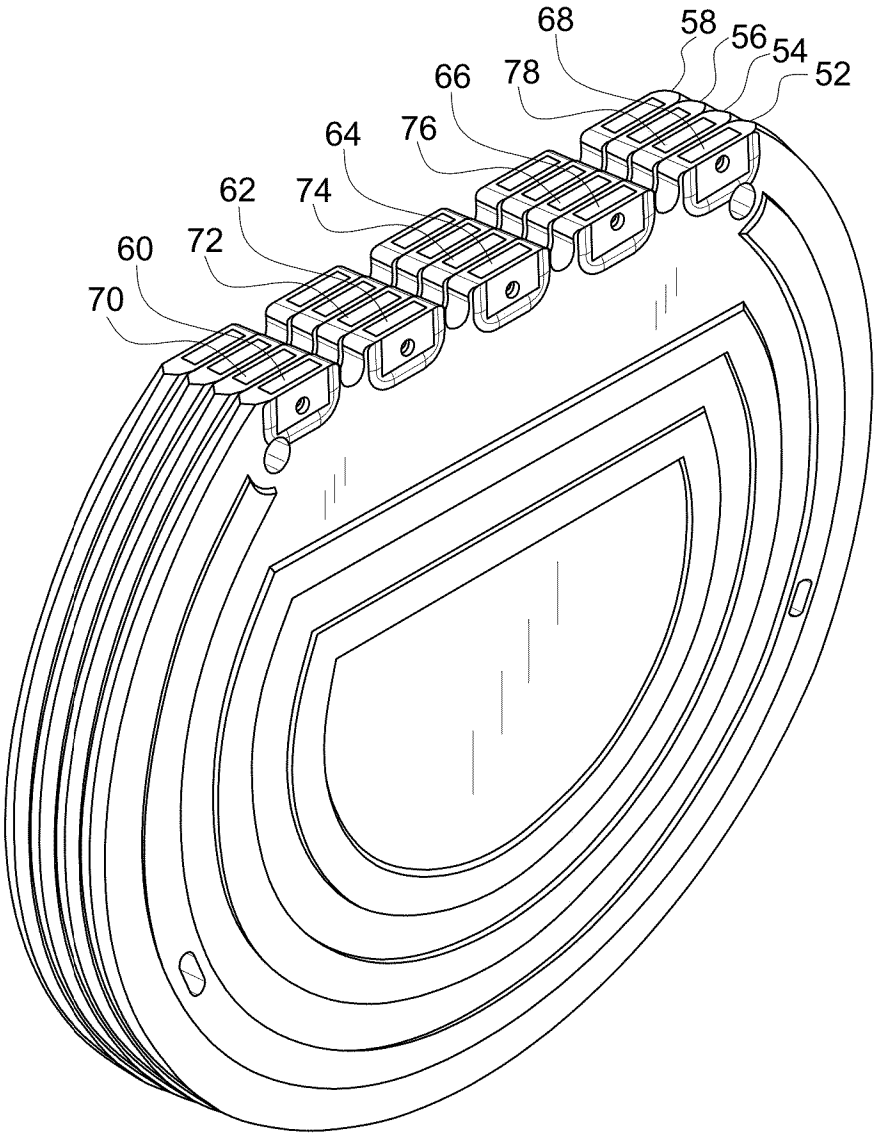
FIG. 16 is perspective view of a plurality of practice targets stacked together and magnetically coupled to each other, according to one embodiment of the invention.

Looking to FIGS. 12 - 14 and 16, there is shown a practice target 20 (FIG. 16 shows a plurality of stacked practice targets) that includes: a front face 22; a rear face 23; a side face 24 with a plurality of pockets 34, including first and second sets of pockets (pockets associated with magnets 60, 62, 64 are a first set and pockets associated with magnets 66 and 68 are a second set) into which are disposed magnets 28, including first and second sets of magnets (60, 62, 64) and (66, 68) respectively. The first and second sets of magnets are oriented opposite each other so that when the practice targets are stacked (See FIG. 16) they have mutual attraction instead of being repelled by like magnets. There are also netting grooves 26 through which netting 38 may extend when the practice target is coupled to a goal post 36 having a net. There are also a plurality of tether apertures 32 through which a tether 40 may extend.

The illustrated front and rear faces 22, 23 are the target regions that the users are shooting to hit. The illustrated faces are circular in profile but may be of any shape that provides for a useful target. They will generally be flat but may include texturing and/or may be decorated, such as but not limited to including logos and the like.

The illustrated side face 24 couples to the goal post via magnetic attraction and is generally a straight edge, since the goal posts have long straight regions to which you would want to couple the target. If it is desired to couple a target to a corner region of a goal post the side face may be elbow shaped to conform thereto.

The illustrated plurality of pockets 34 receive and contain the plurality of magnets 28 and hold them firm within the side face 24. The illustrated figure shows five pockets, but more or fewer pockets may be provided. The number of total pockets may be determined based on the size of the magnets and the length of the side edge. There are two sets of pockets, that have slightly different shapes to hold the two sets of magnets. The illustrated pockets include lateral holes 30 through the front face that match up with pin holes (See 45, 47 of FIG. 15) through the magnets. The two sets of illustrated pockets may be differentiated from each other by the precise locations of the lateral holes, as the pin holes of the magnets are off-center, but the magnets are all flush with the edge of the side face. Accordingly, one set of pockets has lateral holes that are further away from the edge of the side face than the other set of pockets.

The illustrated magnets 28 couple the practice target to the goal posts. They are flush with the edge of the side face in order to minimize leveraging effects, thus holding the practice target securely to the goal post. Each magnet is disposed within a pocket. There are two sets of magnets and those two sets have differing magnetic orientations with respect to each other as disposed within the pockets. In the illustrated example magnets 60, 62, and 64 have one magnetic orientation while magnets 66 and 68 have a magnetic orientation that is opposite that of magnets 60, 62, and 64.

The illustrated netting grooves 26 are disposed between the pockets and provide space into which netting cords may extend thereby allowing the magnets to all be flush with the goal post while coupled thereto without the netting cords being in the way. The netting grooves are shaped, sized, and spaced apart to substantially match with typical netting hole sizes and netting cord sizes so that it is easy to fit the netting cords through the grooves.

The illustrated tether apertures 32 provide anchor points that may be used for packaging (e.g. stacked targets may be coupled together with a tightened plastic strip through lined up tether apertures). The tether apertures may be used during operation to put a bungee or other tether 40 through to couple to the net and/or goal post keep the targets from flying all over when they are struck. This makes it easier to reset the target.

The stacked targets of FIG. 16 are alternating front-back and back-front so that the fronts and backs of adjacent targets touch. This, combined with having two sets of magnet orientations, allows for the magnets to be attracted to each other while the targets are stacked. In the illustrated example, there are four targets 52, 54, 56, 58 stacked together. The front-most two targets 52, 54 are flipped relative to each other, so that the back of the front-most target 52 is pressed against the back of the adjacent target 54. The two targets 53, 54 are substantially identical to each other.

Therefore the first set of magnets 60, 62, and 64 of the front-most target all have the same magnetic orientation (as can be seen by the position of the lateral holes for those pockets), which is the same magnetic orientation as first set of magnets 74, 76, 78 of the adjacent target. Also, the second set of magnets 66, 68 of the front-most target have the same magnetic orientation as each other and the same magnetic orientation as second set of magnets 70, 72 of the adjacent target 54, which is opposite to the magnetic orientation of the first set of magnets 60, 62, 64, 74, 76, 78 (as may be seen by the different position of the lateral holes associated with magnets 66, 68 as compared to the lateral holes associated with the first set of magnets). Therefore, as shown, adjacent magnets for four pairs of adjacent magnets are opposite in magnetic orientation and therefore attractive to each other. Specifically, the following pairs of magnets are opposite in magnetic orientation and therefore attractive (60,70), (62,72), (66,76), (68,78). The middle pair of adjacent magnets (64,74) has the same orientation and therefore repel each other, but this is far outweighed by the four sets that attract. Wherein an even number of magnet-pocket sets is present (e.g. 4 instead of the illustrated 5), and sets of magnets are in equal amounts and either alternating or grouped together, no magnet pairs will repel. Where there is an odd number of magnet-pocket set and the sets of magnets differ in number from each other by only one magnet then it is possible to have all but one magnet pair attract by having the magnet sets be grouped together.

In one non-limiting embodiment, there is a plastic target with magnets that are embedded in the edge and they allow you to magnetically attach it to any ferromagnetic surface. The target will generally be primarily a goal for sports (e.g. hockey, lacrosse). You can shoot a puck or ball at it and attempt to knock it off the post. That way you can tell if you've made a good shot (since the pucks tend to be small and fast so it is often difficult to see exactly where the puck traveled) and can practice taking shots at particular locations over and over. The target can easily be attached at any point around the net without requiring any additional components to be mounted to the net. Multiple targets can be attached to the same goal posts at varying locations so that you can make many shots at the goal before having to reset the targets. The targets are portable and stack together in a single pile instead of deflecting each other because the magnets have orientations, as positioned in the pockets, that are offset or alternating in some manner, so that opposite magnet orientations of adjacent targets may be next to each other. The magnets are firmly secured within the pockets by interlocking irregularities in the shapes of the magnets (convexities and/or concavities, e.g. notches, grooves, protrusions) which makes the targets are more durable than other targets on the market, hold better to the goal posts, and last longer. The targets are also better able to handle larger temperature differences. The magnets are permanently molded into the pockets of the plastic edge.

Figure 13:
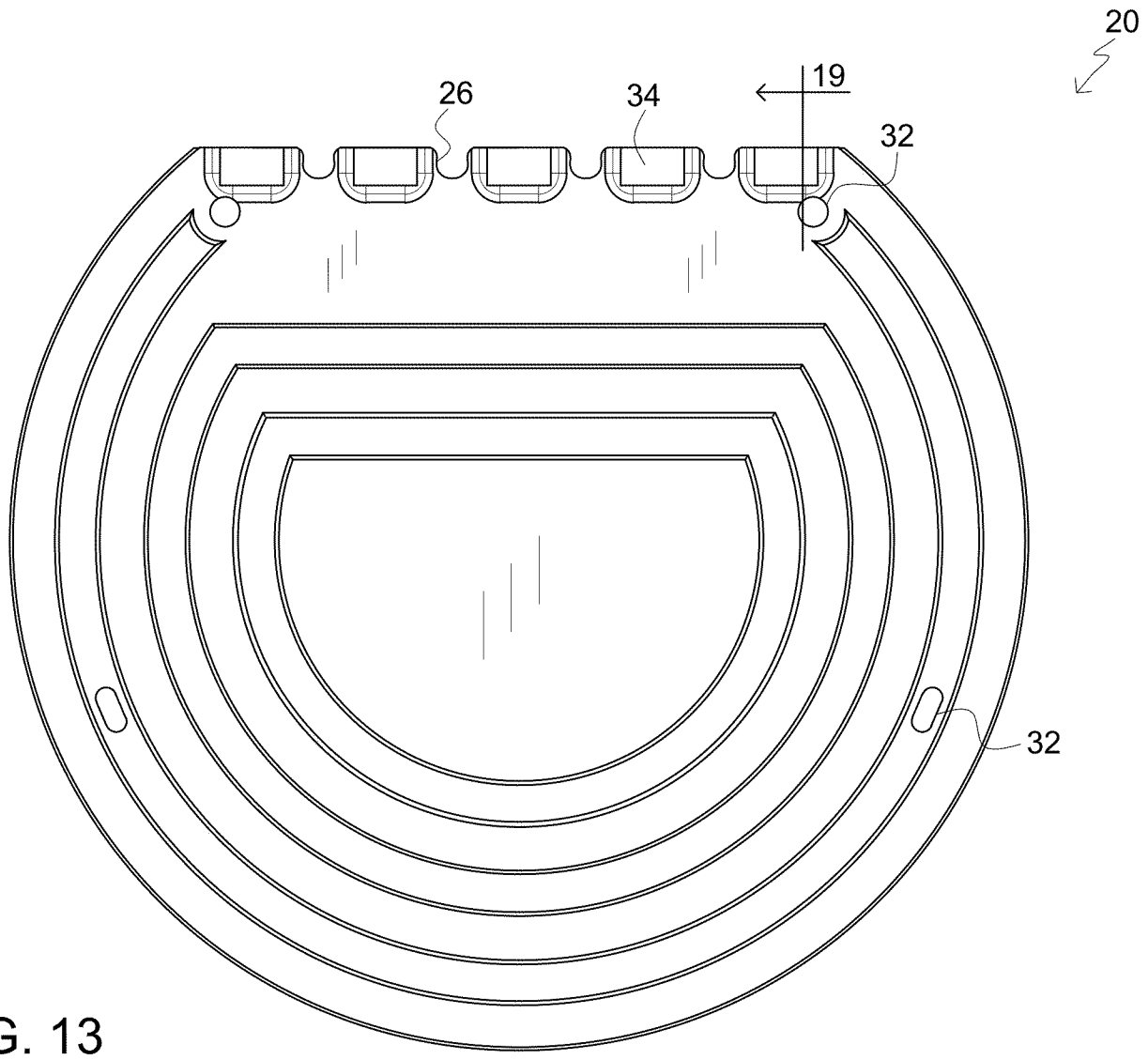
FIG. 13 is a side elevational view of a practice target, according to one embodiment of the invention.
Figure 14:
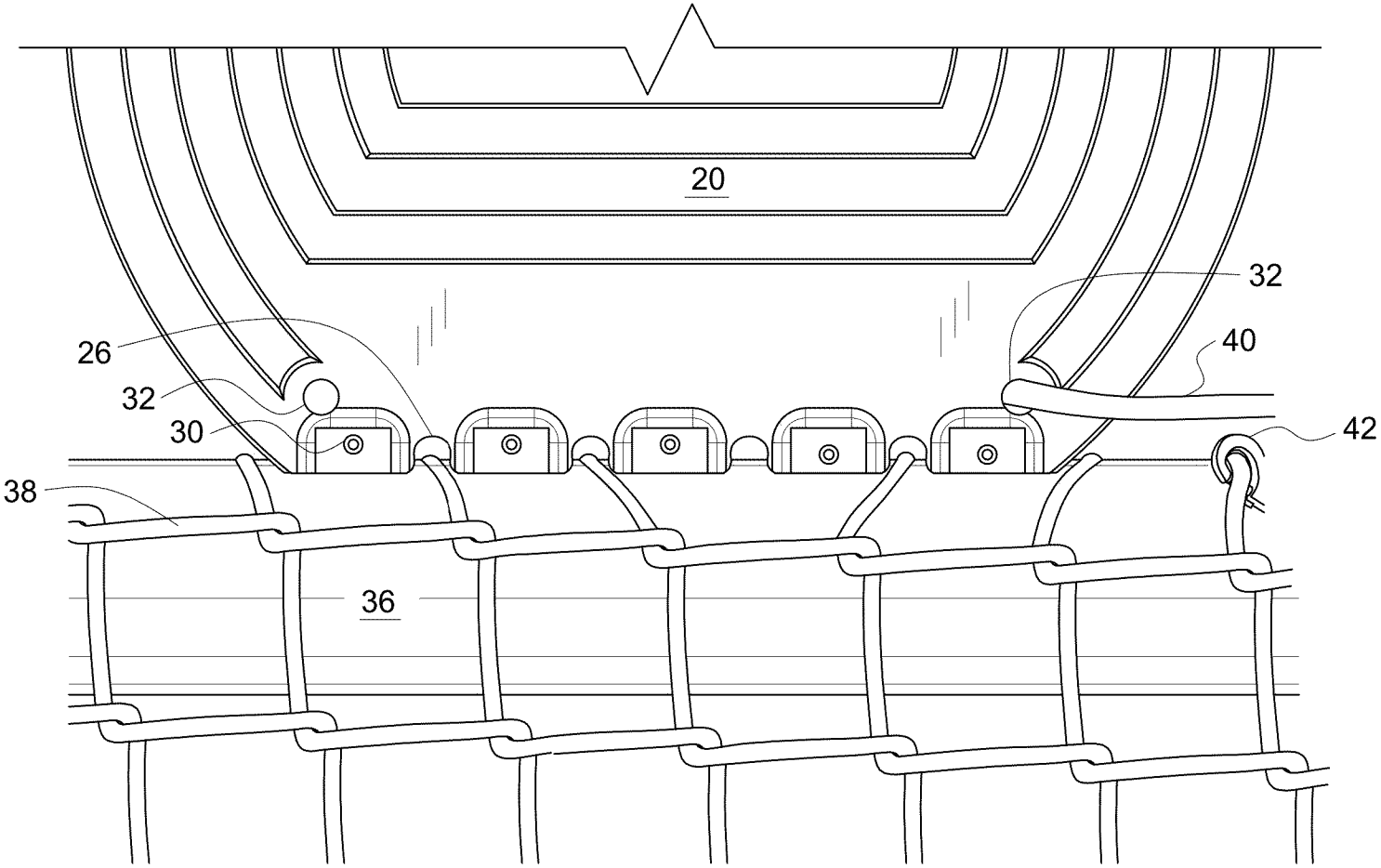
FIG. 14 is a partial side view of a practice target having face slots magnetically coupled to a goal post and tethered to a net line with net lines running through the face slots, according to one embodiment of the invention.
Figure 15:
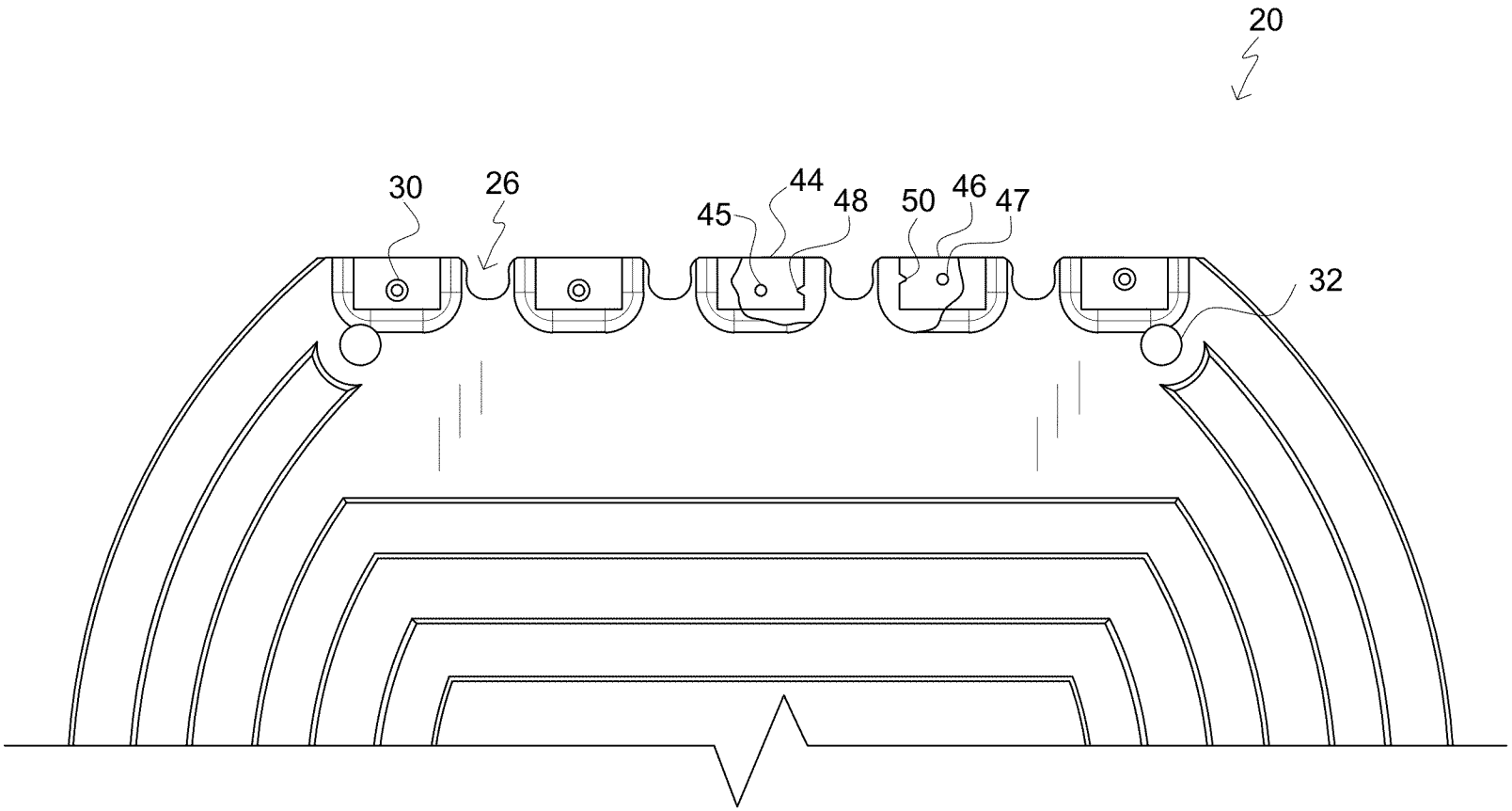
FIG. 15 is a partial side partial cutaway view of a practice target, according to one embodiment of the invention showing magnet position and orientation within the face of the practice target.
Figure 17:
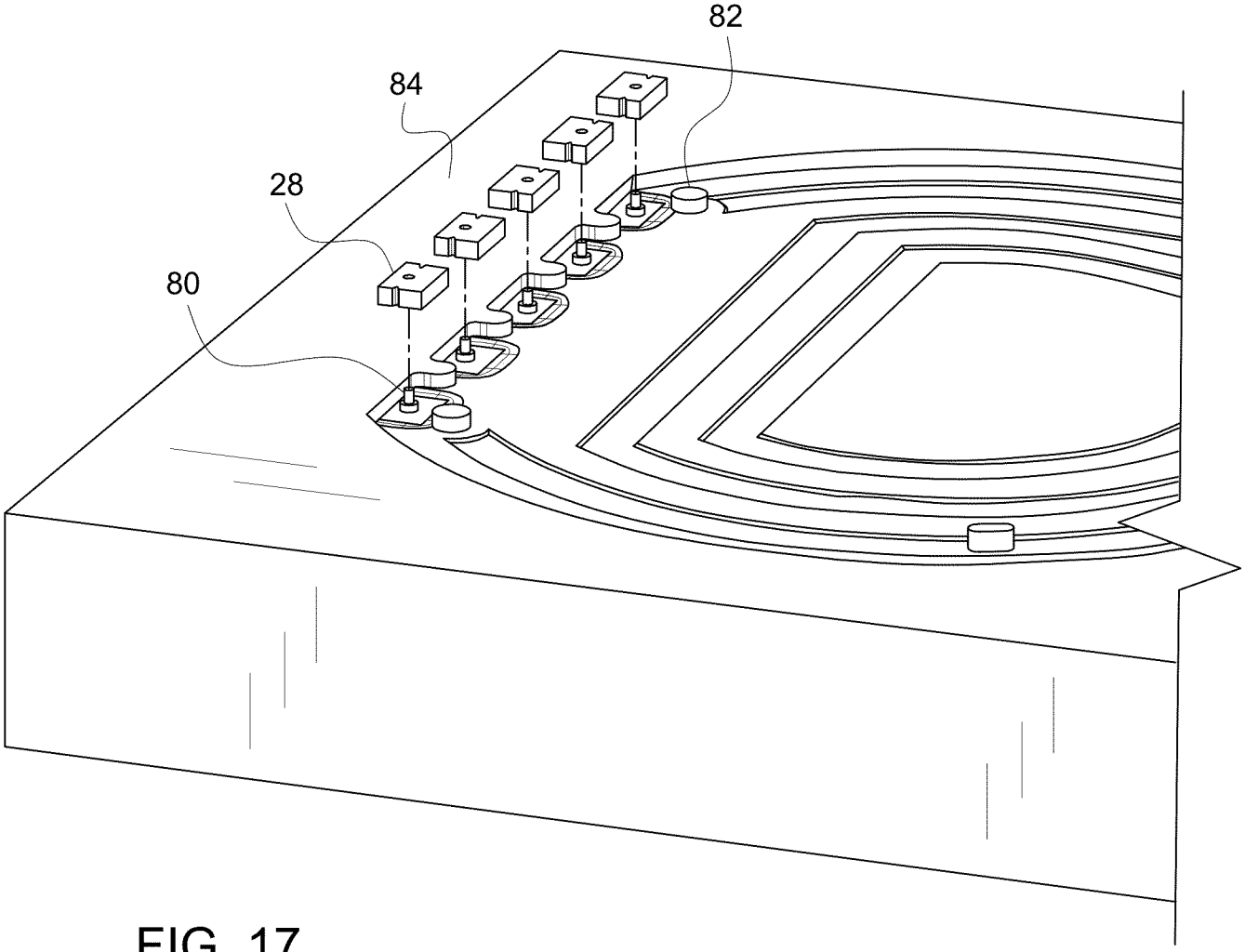
FIG. 17 is a partial exploded perspective view of a bottom mold and a plurality of magnets used in a method of manufacturing a practice target, according to one embodiment of the invention.
Figure 18:
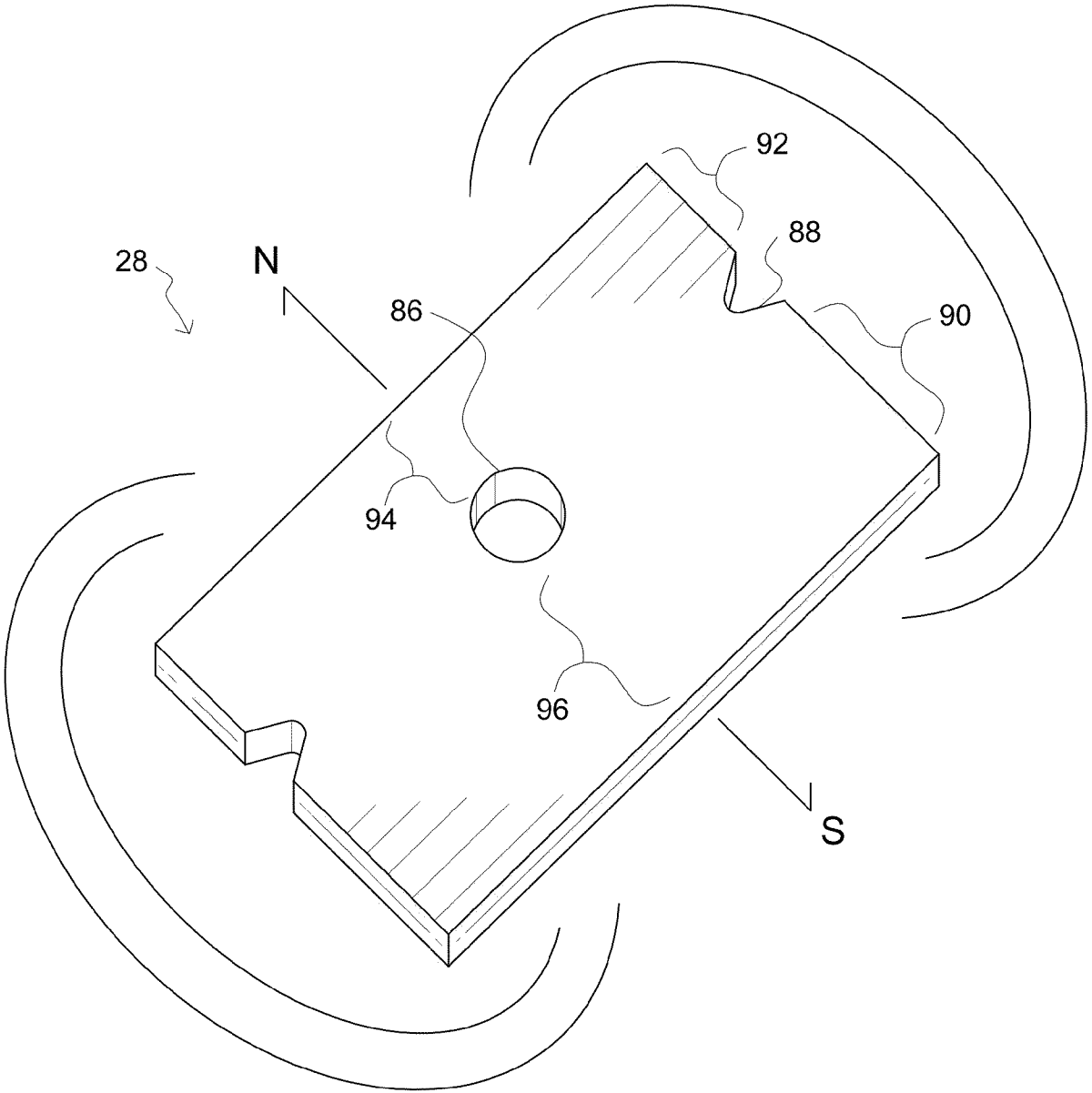
FIG. 18 is a perspective view of a magnet of a practice target, according to one embodiment of the invention.
Figure 19:
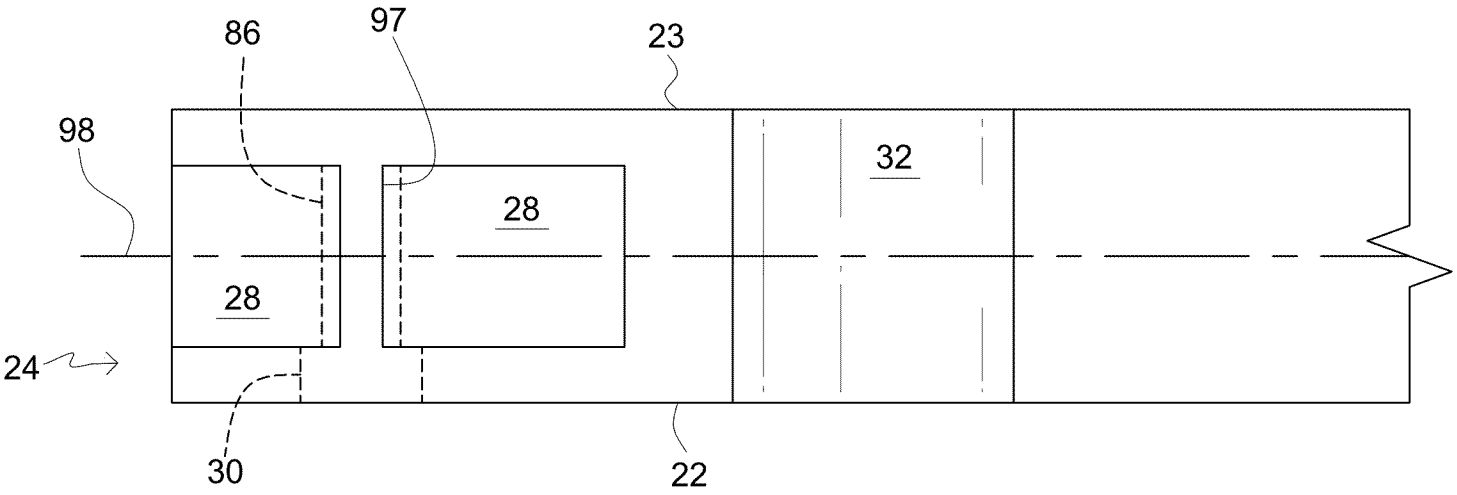
FIG. 19 is a partial cross-sectional view of a practice target, according to one embodiment of the invention.

Looking to FIGS. 15, and 17 -19, there is shown details regarding the magnets, their interface with the pockets and how that relates to their manufacture. In particular, FIG. 15 shows cutaway views of magnets disposed within pockets of a partial view of a practice target, FIG. 17 shows an exploded view of magnets being disposed within a bottom mold for manufacture, FIG. 18 shows a magnet of FIGS. 15, 17, and 19, and FIG. 19 shows a cross-section of FIG. 13, showing a magnet trapped within a pocket.

The illustrated practice target 20 includes a pair of tether apertures 32 and a plurality of magnets in pockets, which pockets include lateral holes 30 that are aligned with respective pin holes 45, 47 (also 86) of the magnets within the pockets. This may be a result of a method of manufacture, wherein a mold (e.g. the illustrated bottom mold 84) includes a plurality of pins 80 that are tapered (the illustrated pins are tapered step-wise, being cylinders with two effective radii, the smaller radius at a top region and the larger radius at a bottom region of the pin) such that the magnets 28, when seated on the pins 80 through the pin holes are not able to sink all the way to the bottom of the pins, leaving a space between a bottom surface of the magnet and the bottom mold. This allows plastic/resin to fill in underneath the magnet forming a bottom portion of the pocket. Since the plastic/resin cannot fill in the space occupied by the pin, lateral holes remain that communicate with the pin holes of the magnets. Similarly, the posts 82 (and a corresponding post on a top mold) prevent plastic/resin from filling in the space occupied by the post 82, which leaves tether apertures 32 through the practice target.

Of note, the illustrated magnets are identical to each other in shape. As such the first and second sets of magnets are identical in shape to each other. The magnets 28 include notches/cutouts/protrusions/etc. 88 that matches with similar structures 97 in the pockets to hold them in place in the pockets. The illustrated notches 88 are off-center (the illustrated distance 92 is smaller than the distance 90). There are off-center pin holes 86 (as illustrated, the distance 94 is smaller than the distance 96, which makes the pin hole off center) through the magnets that make sure that they are oriented correctly during injection molding. In particular, when the magnets are placed in the mold, one set of pins of the mold are closer to the nearby edge of the mold than another set. They are spaced from the nearby edge in an amount so that the magnets, when seated on the pins press up snugly to the nearby edge, but only if they are oriented correctly. If they are oriented incorrectly, they will either not extend to the nearby edge, and thereby be able to pivot (also, plastic/resin would be able to fill in the space between the magnet and the nearby edge, thus completely encasing the magnet in the pocket), or they will not seat at all, since the magnet will extend beyond the nearby edge and be unable to simultaneously fit on the pin and seat within the bottom mold. Where the magnets are all identical and uniformly magnetically oriented with respect to the location of the pin hole (e.g. the illustrated non-limiting North and South poles of the magnet in FIG. 18), this allows one to be certain that a properly formed practice target has properly magnetically oriented sets of magnets. An injection molded practice target that includes all of the magnets and wherein all of the magnets are visible (i.e. not completely encased) through the face 24 will, because of the geometry of the mold in cooperation with the off-center pin holes of the magnets, always have the proper orientations.

There are also netting grooves 26 between the plurality of pockets which are formed by associated flanges in the molds. FIG. 19 shows an axis line 98 representing where a bottom mold and a top mold may come together during injection molding of a practice target.

In one non-limiting embodiment, a practice target is an injection molded product using HDPE with a mix of other additives for durability. The mold is created. As one is making each target, one inserts magnets into the mold. The magnets are inserted in an alternating pattern (e.g. Orientation A and Orientation B for a five magnet set may be AAABB, while a four magnet set may be AABB or ABAB) such that when adjacent practice targets are adjacent but flipped with respect to each other, they attract. The pins/posts in the mold are offset from the nearby edge and mate up with the magnets so that the magnets can only be inserted in a proper orientation. The mold closes and then one shoots molten plastic/resin inside. One lets it cool and then open the mold to release the targets. The magnets are shaped asymmetrically to only fit into the mold in one orientation. The magnets include grooves into which the molten plastic flows so that the plastic holds the magnet inside the cavity. The magnet faces are flush with the side surface of the target. The magnets may be N52 grade magnets.

In one non-limiting embodiment, there is a method of manufacturing a practice target, including the steps of providing a mold for a practice target, the mold including a side face boundary; placing a plurality of magnet bodies within a mold such that each magnet body is speared by a pin of the mold located near a side of the mold and each magnet body abuts the side of the mold, wherein the pins are not all at the same distance from the side face boundary of the mold and wherein each pin is tapered to be larger than pin holes in the plurality of magnets at a bottom region of the pin that prevents the associated magnet body from resting on a floor of the mold; closing the mold; and injecting a plastic material into the mold.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A practice target, comprising:

a. a front face;

b. a rear face, the rear face opposite the front face;

c. a side face at a side end of the practice target and adjacent to each of the front face and rear face:

d. a plurality of pockets disposed along the side face, the plurality of pockets including a first set of pockets and a second set of pockets;

e. a plurality of netting grooves extending through each of the front face, side face, and the rear face, the netting grooves disposed between the plurality of pockets;

f. a tether aperture through the front face and the rear face; and g. a plurality of magnets, including:

i. a first set of magnets disposed within the first set of pockets and oriented according to a first magnetic orientation; and ii. a second set of magnets disposed within the second set of pockets, wherein the second set of magnets are oriented within the second set of pockets to have a magnetic orientation that is opposite to the first magnetic orientation.

2. The practice target of claim 1, wherein each of the plurality of magnets includes a magnet body having a magnet convexity and/or concavity disposed thereon that mates with a corresponding pocket concavity and/or convexity of an associated pocket within which the magnet body is disposed which operate together to secure the magnet body within the associated pocket.

3. The practice target of claim 1, wherein a magnet of the plurality of magnets includes a pair of concavities disposed opposite each other along sides of the magnet which mate with a pair of convexities within a pocket inside which the magnet is disposed to secure the magnet, wherein the pair of concavities are disposed off-center along their respective sides.

4. The practice target of claim 1, wherein each of the plurality of magnets are rectangular and have an identical irregularity in shape mating with a corresponding irregularity in shape in each corresponding pocket and a pin hole that is disposed off-center along at least one axis and wherein each of the plurality of magnets has a same magnetic orientation in relation to the position of the pin hole.

5. The practice target of claim 1, wherein the tether aperture is disposed near an edge of the practice target midway between the side face and a face opposite the side face.

6. The practice target of claim 1, wherein a difference between a number of magnets of the first set of magnets and a number of magnets of the second set of magnets is no greater than one.

7. A disc-shaped practice target, comprising:

a. a disc having a front face and a rear face, the front face not extending through a plane created by an outer surface of the rear face;

b. wherein the rear face is opposite the front face, and the rear face is not extending through a plane created by the outer surface of the front face;

c. a side face at a side end of the disc-shaped practice target and adjacent to each of the front face and rear face, the side face not extending through the planes created by the outer surface of either of the front or rear faces, wherein the side face has a smaller surface area than one of the front or rear faces;

d. a plurality of pockets disposed along the side face, the plurality of pockets including a first set of pockets and a second set of pockets; and e. a plurality of magnets, including:

i. a first set of magnets disposed within the first set of pockets and oriented according to a first magnetic orientation; and ii. a second set of magnets disposed within the second set of pockets, wherein the second set of magnets are oriented within the second set of pockets to have a magnetic orientation that is opposite to the first magnetic orientation, such that a plurality of targets may be magnetically attracted to one another.

8. The practice target of claim 7, wherein each of the plurality of magnets includes a magnet body having a magnet convexity and/or concavity disposed thereon that mates with a corresponding pocket concavity and/or convexity of an associated pocket within which the magnet body is disposed which operate together to secure the magnet body within the associated pocket.

9. The practice target of claim 8, wherein each of the plurality of magnets are rectangular and has a pin hole that is disposed off-center along at least one axis and wherein each of the plurality of magnets has a same magnetic orientation in relation to the position of the pin hole.

10. The practice target of claim 9, further comprising a tether aperture through the front face and the rear face disposed midway between the side face and a face opposite the side face.

11. The practice target of claim 10, wherein a difference between a number of magnets of the first set of magnets and a number of magnets of the second set of magnets is no greater than one.

12. The practice target of claim 11, wherein the front face and rear face are substantially flat such that a plurality of practice targets may be stacked together.

13. The practice target of claim 7, wherein each of the pockets includes a lateral hole through either the front face or the rear face that matches with the pin hole of the corresponding magnet body.

14. A practice target, comprising:

a. a front face, the front face having an outer edge that defines the front face and gives the front face a disc-like shape;

b. a side face;

c. a plurality of pockets disposed along the side face, the plurality of pockets including a first set of pockets and a second set of pockets; and d. a tether aperture disposed through the practice target and disposed away from the plurality of pockets; and e. a plurality of magnets, wherein the plurality of magnets are substantially identical in shape to each other, including:

i. a first set of magnets disposed within the first set of pockets and oriented according to a first magnetic orientation; and ii. a second set of magnets disposed within the second set of pockets, wherein the second set of magnets are oriented within the second set of pockets to have a magnetic orientation that is opposite to the first magnetic orientation, wherein each magnet of the plurality of magnets includes a pair of concavities disposed opposite each other along sides of the magnet which mate with a pair of convexities within a pocket inside which the magnet is disposed to secure the magnet, and wherein the pair of concavities are disposed off-center along their respective sides.

15. The practice target of claim 14, wherein each magnet of the plurality of magnets includes a pin hole disposed off-center therethrough.

16. The practice target of claim 15, wherein each magnet of the plurality of magnets is rectangular.

17. The practice target of claim 16, wherein each of the pockets includes a lateral hole through either the front face or the rear face that matches with the pin hole of the corresponding magnet body but is larger in diameter than the associated pin hole.

18. The practice target of claim 17, further comprising a plurality of netting grooves disposed between the plurality of pockets;.

19. The practice target of claim 18, wherein a difference between a number of magnets of the first set of magnets and a number of magnets of the second set of magnets is no greater than one.

* * * * *